US008714703B2

(12) United States Patent
Leoni et al.

(10) Patent No.: US 8,714,703 B2
(45) Date of Patent: May 6, 2014

(54) APPARATUS, IMAGE FORMING APPARATUS, AND ARTICLES OF MANUFACTURE

(75) Inventors: Napoleon Leoni, San Jose, CA (US); Omer Gila, Cupertino, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 305 days.

(21) Appl. No.: 13/098,354

(22) Filed: Apr. 29, 2011

(65) Prior Publication Data

US 2012/0274681 A1 Nov. 1, 2012

(51) Int. Cl.

| | |
|---|---|
| ***B41J 2/165*** | (2006.01) |
| ***B41J 2/06*** | (2006.01) |
| ***B41J 2/02*** | (2006.01) |

(52) U.S. Cl.
USPC ..... 347/34; 347/55; 347/73

(58) Field of Classification Search
USPC ..... 347/34, 55, 73
See application file for complete search history.

(56) References Cited

U.S. PATENT DOCUMENTS

| | | | | |
|---|---|---|---|---|
| 3,520,172 | A | 7/1970 | Liu et al. | |
| 3,997,113 | A * | 12/1976 | Pennebaker, Jr. | 239/708 |
| 4,495,508 | A * | 1/1985 | Tarumi et al. | 347/123 |
| 4,641,955 | A * | 2/1987 | Yuasa | 347/124 |
| 4,736,255 | A * | 4/1988 | Miura et al. | 358/300 |
| 5,450,115 | A | 9/1995 | Bergen et al. | |
| 6,349,024 | B1 | 2/2002 | Gundlach | |
| 7,261,764 | B1 | 8/2007 | Pletcher | |
| 2010/0221043 | A1 | 9/2010 | Gotoda et al. | |

* cited by examiner

*Primary Examiner* — Jason Uhlenhake

(57) ABSTRACT

Apparatus, articles of manufacture, and image forming apparatus for capturing aerosols are disclosed. An example apparatus includes a corona wire, and an excitation source to provide to the corona wire a composite signal having a direct current component and an alternating current component, the alternating current component having a cycle, a first portion of the cycle being sufficient to cause the composite signal to exceed an inception voltage at which ions are generated by the corona wire and a second portion to cause the composite signal to fall beneath the inception voltage, the excitation source to avoid causing the corona wire to substantially charge a substrate.

20 Claims, 7 Drawing Sheets

APPARATUS, IMAGE FORMING APPARATUS, AND ARTICLES OF MANUFACTURE

BACKGROUND

Corona discharge occurs when a sufficient voltage is applied between two conductors with an appropriate geometry to ionize a fluid, such as air, between the conductors, causing ions to flow from one of the conductors to the other. Additionally, the ions may interact with other particles in the fluid. Corona discharge has been previously used in early-generation desktop laser printers and is still used in high-speed laser-based presses and printers to apply electrostatic charge to an imaging drum.

DETAILED DESCRIPTION

Figure 1:
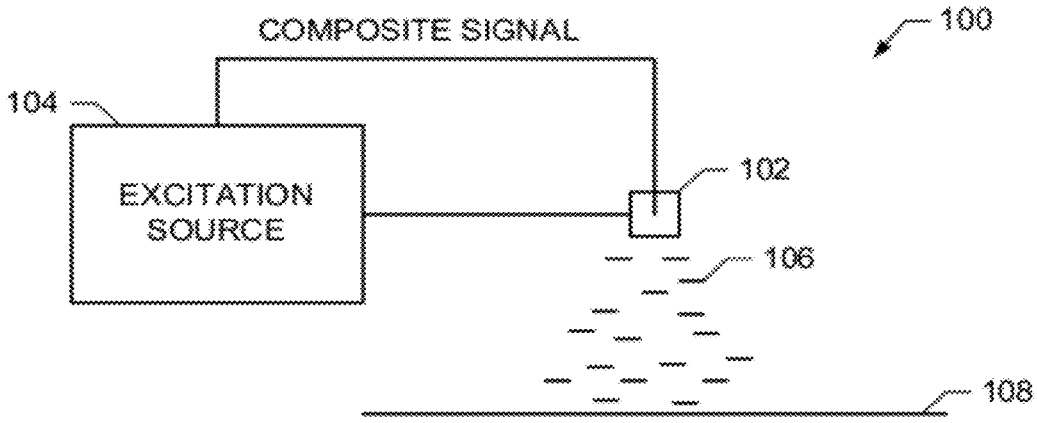
FIG. 1 illustrates an example apparatus including a corona wire to generate ions in response to a composite signal, in accordance with the teachings herein.

Example apparatus described herein may be used to reduce or eliminate aerosols such as ink aerosols from an inkjet printer or press. Ink aerosols are tiny particles of ink and/or other fluids (e.g., solvents) that are output from inkjet press pens (e.g., print head(s)) but which do not immediately land on the print substrate (e.g., paper). Instead, the ink particles linger for at least a time in the air region between, for example, the print head(s) and the substrate. Aerosols may cause several problems. For example, the aerosols may travel with the moving air to other print head (s) and, thus, may alter the color output of those other print head(s). Aerosols may also land on electronic components of the inkjet press, which may cause the components to be short-circuited and/or which may ignite some types of aerosols. Aerosols may also eventually land on the print substrate and adversely affect print quality.

Traditionally, air vacuums have been used to remove aerosols that do not land on the print substrate. However, an air boundary layer between the vacuum intake and the inkjet pens may not be penetrated by air vacuums and, thus, some of the aerosols may not be captured.

Conventional corona wires and conventional excitation sources used to capture ink aerosol in an inkjet printer use DC voltages, which can cause the corona wire to suffer from uneven current densities at different points along the length of the corona wire. As a result, sections of the corona wire may not effectively capture adjacent ink aerosol particles, which may then contaminate other portions of the printer and/or escape to an external environment. On the other hand, conventional corona wires having a relatively high average current density will charge the print substrate, which can cause print defects due to deflections of ink droplets by the charged substrate.

Example image forming apparatus disclosed herein include a corona wire affixed in proximity to one or more inkjet pens. In some examples, the corona wire is located directly in front of and/or behind the print head(s) relative to the direction of print substrate travel. The corona wire forces aerosols (e.g., fluid aerosol particles such as ink particles) from the air onto the print substrate and/or other collection surface to reduce or even prevent any negative effects of aerosols lingering in the air. In operation, the example corona wire is excited by an excitation source generating a composite signal, causing the corona wire to selectively generate ions to force the aerosols toward the collection surface. In examples disclosed below, the composite signal includes an alternating current (AC) component and a direct current (DC) component or bias.

In some examples, a corona wire voltage and/or a time-averaged current density may be selected to generate ions during a first period of the composite signal to capture aerosol particles adjacent the corona wire, to stop generating ions during a second period of the composite signal during which aerosol particles diffuse to the corona wire, and to generate ions during a third period of the composite signal to capture the diffused aerosol particles adjacent the corona wire. The duration(s) of example first, second, and third periods are selected (e.g., by selecting DC component(s) and/or AC component(s) of the composite signal) to reduce or prevent aerosol particles from diffusing beyond the capture range of the corona wire. In some examples, the selection of the DC component(s) and/or AC component(s) reduces an average (e.g., time-averaged) current between the corona wire and a collection surface while capturing aerosol particles. In some examples, selection of the DC component(s) and/or AC component(s) of the composite signal overcome problems of the prior art system by reducing and/or avoiding excessive charging of a print substrate or other surface by generating time-averaged current densities on the corona wire that are less than about 10 microamperes per centimeter (μA/cm), thereby avoiding negatively effects on print quality resulting from the excessive charging seen in the prior art.

As used herein, substantially avoiding charging a print substrate refers to avoiding applying electrical charges to a print substrate in a manner that would negatively affect print and/or hard image quality when measuring using objective and/or subjective measures. By way of example, substantially charging a print substrate may be said to have occurred if a sharpness of a hard image on the print substrate has been subjectively reduced and/or if effects such as streaks are introduced into a hard image.

As used herein, an excitation source or electrical excitation source includes excitation sources that convert commercial, mains and/or grid electrical power to some other form of excitation (e.g., converting commercial power to DC and/or AC, changing a voltage from the mains or grid power to a higher or lower voltage, etc.). The terms "excitation sources" or "electrical excitation sources," as used herein, do not include the commercial, mains, or grid electrical power, infrastructure such as power lines, electrical power generation equipment, and/or utilities.

FIG. 1 illustrates an example apparatus 100 to generate ions in response to a composite signal. The example apparatus 100 of FIG. 1 may be used in an image forming apparatus or other aerosol-generating device, such as a printer, to capture aerosols and/or reduce or prevent aerosol particles from escaping a contained volume.

The illustrated apparatus 100 of FIG. 1 includes a corona wire 102 electrically coupled to an excitation source 104. The example corona wire 102 is coupled to the source 104 (e.g., an electrical excitation source such as an electrical power supply) to form an electrical circuit. The example connector 103 of FIG. 1 may include electrical connections and/or mechanical support(s) to provide a signal from the excitation source 104 to the corona wire 102. In operation, the source 104 provides a composite signal comprising an AC voltage (e.g., an AC component) having a DC bias (e.g., a DC component) to the corona wire 102 to cause the corona wire 102 to selectively generate ions 106 (e.g., positive or negative ions). The ions 106 are directed toward a collection surface 108 and cause a corona wind. A corona wind is an airflow in the direction of ion travel caused by the ions 106 traveling and creating drag with the surrounding air. Example collection surfaces may include print substrates, aerosol collection plates, and/or filter materials. In some examples, the collection surface 108 is grounded (e.g., 0 V, another reference voltage) to provide a reference for the corona wire 102 to generate the ions 106. In some other examples, however, the collection surface 108 is between the corona wire 102 and another conductive surface that provides the reference voltage (e.g., when the collection surface 108 is a substrate traveling along a platen, etc.).

Figure 2:
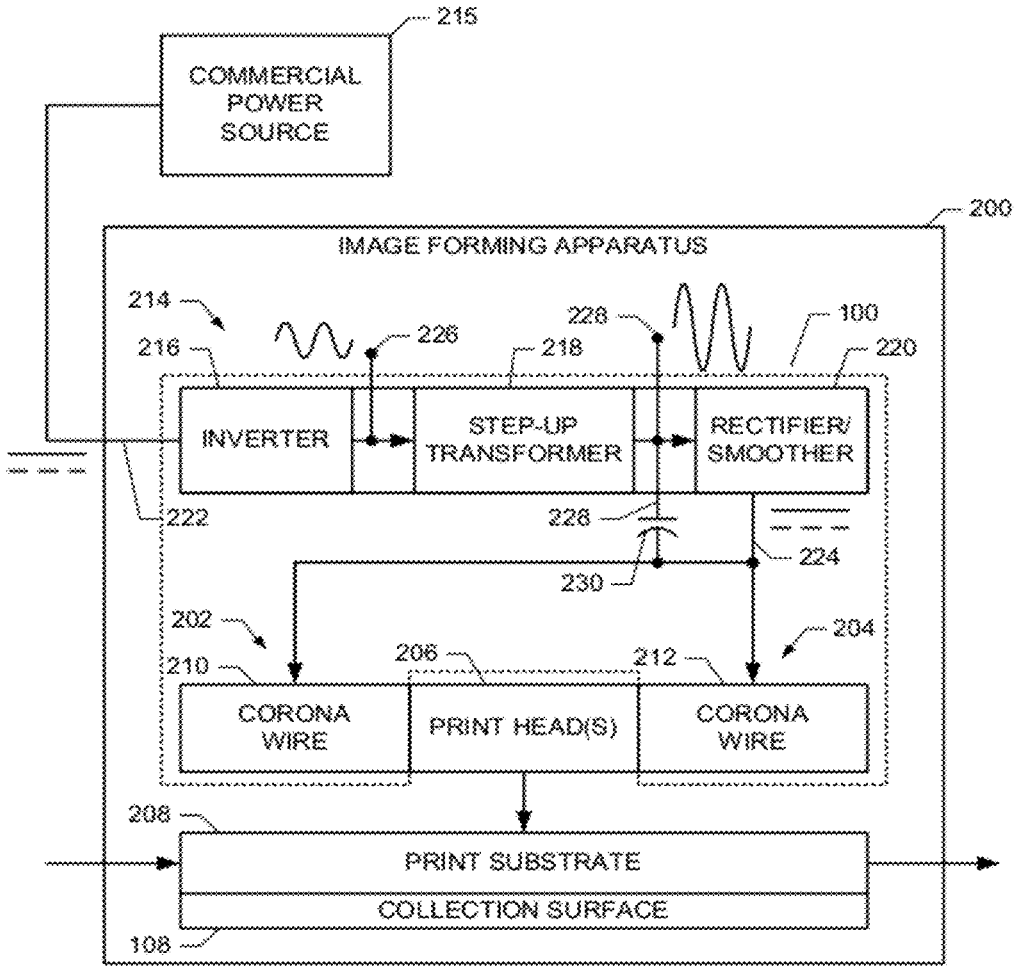
FIG. 2 is a block diagram of an example image forming apparatus including corona wires to capture fluid aerosols, in accordance with the teachings herein.

FIG. 2 is a block diagram of an example image forming apparatus 200 incorporating the apparatus of FIG. 1. In the example of FIG. 2, the apparatus of FIG. 1 has been modified to include multiple corona wires 202 and 204 to capture fluid aerosols (e.g., ink aerosol particles). The example image forming apparatus 200 includes print head(s) 206 that apply ink(s) and/or other types of liquid marking agent(s) to a print substrate 208 to form hard images. Different types of inks, such as aqueous, solvent or oil based, may be used depending upon the configuration of the image forming apparatus 200 and/or the print head(s) 206. Furthermore, the ink and/or liquid marking agents may include a fixer or binder, such as a polymer, to assist with binding inks and/or liquid marking agents to the print substrate 208 and/or reducing penetration of the inks and/or liquid marking agents into the print substrate 208. As used herein, the term "ink" generally refers to any type of inks, liquid marking agents and/or any other fluids that may be ink-jetted.

When the print head(s) 206 apply ink to the print substrate 208, the print head(s) 206 generate ink droplets having a desired size and, as a side effect, generate smaller ink particles. The smaller ink particles, also referred to herein as ink aerosol, aerosol, and/or aerosol particles, may not reach the print substrate 208. Instead, at least some of the ink aerosol particles remain suspended in an air layer between the print head(s) 206 and the print substrate 208. From the air layer, the ink aerosol particles may travel to other parts of the image forming apparatus 200, such as other print head(s) 206, and/or may travel outside the image forming apparatus 200. For example, in the example image forming apparatus 200 of FIG. 2, the print head(s) 206 and/or the print substrate 208 may move rapidly during the printing process, thereby causing air currents that may move the ink aerosol particles within the image forming apparatus 200 and/or cause the aerosol particles to exit the image forming apparatus 200.

Without intervention, the ink aerosol particles can cause various problems. For example, when the ink aerosol particles land, they may collect and form deposits on parts of the image forming apparatus 200. When ink deposits occur on the print head(s) 206, the print quality of the image forming apparatus 200 may suffer as the generation of ink droplets of appropriate size may be impeded by the ink deposits. To reduce ink deposits and, thus, increase print quality, the example image forming apparatus 200 of FIG. 1 includes the first and second corona wires 202, 204. The first corona wire 202 is located on a first side of the print head(s) 206 and the second corona wire 204 is located on a second side of the print head(s) 206. As explained below, the corona wires 202, 204 reduce the amount of ink aerosol present in the image forming apparatus 200. As illustrated in FIG. 2, the first and second corona wires 202, 204 may be located on opposite sides of the print head(s) 206 to contain ink aerosol particles to reduce and/or prevent ink deposits.

The example corona wires 202 and 204 of FIG. 2 selectively generate ions in response to electrical excitation from an excitation source 214. The example electrical excitation source 214 of FIG. 2 may implement the excitation source 104 of FIG. 1 to provide an electrical excitation having an AC component and a DC component to the corona wires 202, 204. The excitation source 214 of FIG. 2 is powered by a source of commercial power 215. In the illustrated example, the excitation source 214 includes an inverter 216, a step-up transformer 218, and a rectifier/smoother 220. The example excitation source 214 receives a relatively low-voltage DC electrical signal 222 (e.g., 12 V DC) and generates a relatively high-voltage DC signal 224 (e.g., 3.5 kV-4.0 kV). However, the example excitation source 214 may additionally or alternatively receive a lower-voltage or higher-voltage DC signal and/or an AC signal from, for example, the commercial power source 215 and/or from a power supply that converts the power from the commercial power source 215.

More specifically, in the illustrated example the inverter 216 receives the low-voltage DC electrical signal 222 and generates an AC signal 226. The inverter 216 provides the AC signal 226 to the step-up transformer 218, which increases the voltage of the AC signal 226 to generate a high-voltage AC signal 228 (e.g., a 1 kV-2 kV peak-to-peak AC signal). The step-up transformer 218 in the illustrated example provides the high-voltage AC signal 228 to the rectifier/smoother 220, which generates the high-voltage DC signal 224.

In the example of FIG. 2, a capacitor 230 superimposes the high-voltage AC signal 228 onto the high-voltage DC signal 224 to generate a composite signal. The composite signal is then provided to the example corona wires 202, 204 (e.g., via the connector 103) to selectively generate ions. The corona inception voltage (or simply "inception voltage") is the voltage required to initiate a visible corona discharge between the corona wires 202, 204 and the reference (e.g., the collection surface 108, the print substrate 208, a platen, etc.). In some examples, the high-voltage DC signal 224 has a voltage less than the inception voltage of the corona wires 202, 204, and the AC signal has a peak-to-peak voltage which, when combined with the DC signal 224, periodically increases the voltage of the corona wires 202, 204 above the inception voltage to generate ions. In the example of FIG. 2, the composite signal causes each of the example corona wires 202, 204 to have a time-averaged current density less than about 10 μA/cm.

Figure 3:
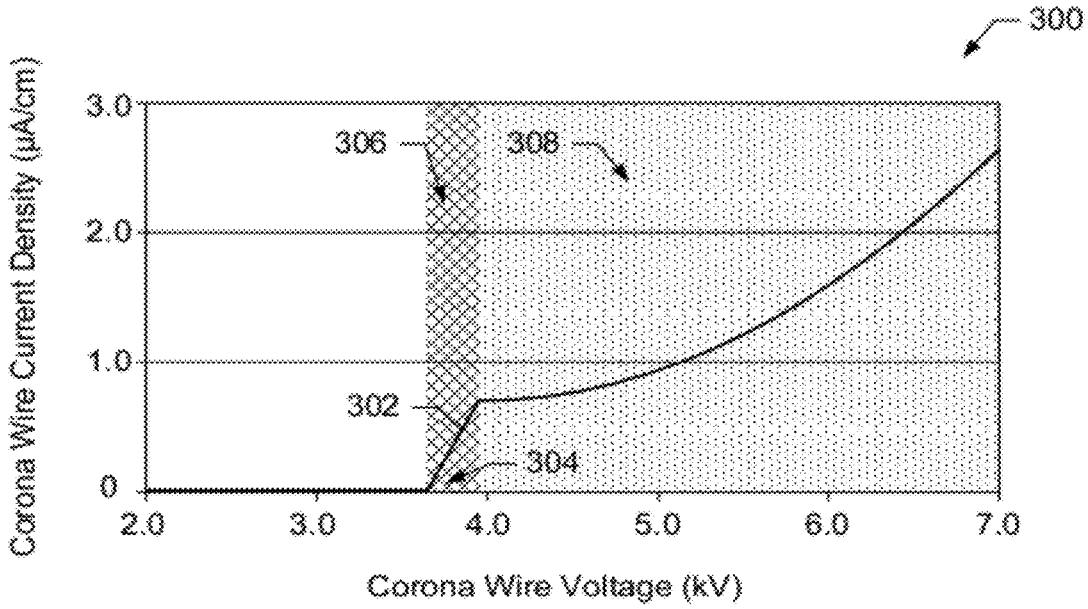
FIG. 3 is a graph illustrating a voltage-to-current density relationship for the example corona wire of FIG. 1.

FIG. 3 is a graph 300 illustrating a voltage-to-current density relationship 302 for the example apparatus 100 of FIG. 1. As illustrated in FIG. 3, the apparatus 100 does not begin producing ions until approximately an inception voltage 304

(e.g., about 3.7-4.0 kV in FIG. 3, depending on the distance between the corona wire and a reference surface). As the example corona wire voltage increases above the inception voltage 304, the corona wire 202, 204 enters a relatively unstable region 306, in which the corona wire 202, 204 may display a negative impedance and/or may have corona discharge along a portion of the corona wire 202, 204 while having no corona discharge along an adjacent portion of the corona wire 202, 204. As the corona wire voltage increases further, the corona wire 202, 204 enters a relatively stable region, in which the corona discharge (e.g., the corona wire current density) is relatively uniform and present along the length of the corona wire 202, 204. The voltage-to-current density relationship 302 and the inception voltage 304 are based on the distance between the corona wire 102 and the collection surface 108.

Additionally, at the inception voltage 304, the current density may be inconsistent along the length of the corona wire 102. For example, some portions of the corona wire 102 have higher current densities and generate ions, while other portions of the corona wire 102 have low current densities and do not produce ions. This inconsistency can also occur above the inception voltage 304 at relatively low current densities. The inconsistency in current density may result in failure to capture aerosols escaping into the surrounding atmosphere, contamination of the corona wire 102 with aerosol particles, and/or reduced efficiency of the example apparatus 100.

Increasing the voltage applied to the corona wire 102 (and, thus, the time-averaged current density) may result in poor efficiency of the corona wire, undesired charging of the print substrate, and/or reduction in print quality due to the increased charge applied to the substrate in an image forming apparatus.

Figure 4:
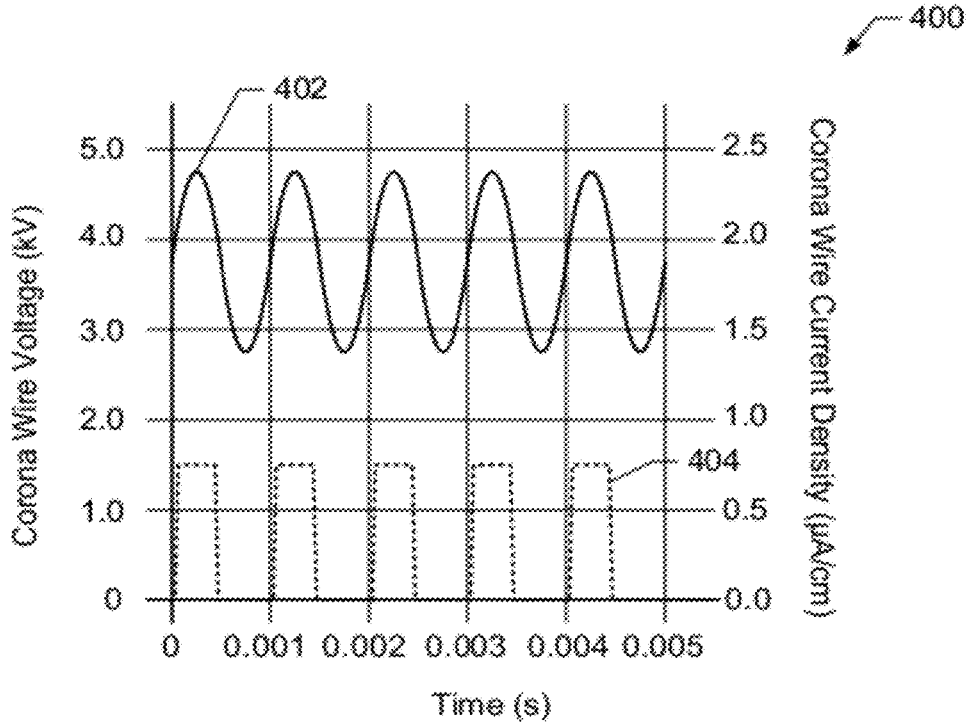
FIG. 4 is a graph illustrating example corona wire voltages and currents during operation of the example image forming apparatus of FIG. 2.

FIG. 4 is a graph 400 illustrating example corona wire voltages 402 and current densities 404 during operation of the example image forming apparatus 200 of FIG. 2. As described above, during operation of the image forming apparatus 200, the example excitation source 214 generates a signal having AC and DC components at the corona wires 202, 204. Known excitation sources, on the other hand, generate only DC voltages along the corona wire(s), resulting in uneven current densities at different points along the length of the corona wire.

The corona wire voltage 402 is a composite signal generated by the example excitation source 214 of FIG. 2 and includes an AC component (e.g., the high-voltage AC signal 228) and a DC component (e.g., the high voltage DC signal 224). In the illustrated example, the DC component has a voltage of about 3.7 kV and the AC component has a peak-to-peak voltage of about 2 kV. The inception voltage of the example corona wires 202, 204 of FIG. 2 is about 4 kV. As a result, when the AC component drives the corona wire voltage 402 above 4 kV (relative to the reference voltage at the collection surface 108), the corona wires 202, 204 begin generating ions to capture fluid aerosols and force the aerosols toward the print substrate 208 and/or the collection surface 108. As illustrated in FIG. 4, the corona wire current density 404 increases from 0 to about 0.7 μA/cm.

When the corona wire voltage 402 decreases below 4 kV (e.g., due to the AC signal component), the corona wires 202, 204 stop generating ions and the current density 404 falls to substantially 0. Thus, the current density 404 can be thought of as a pulse-width modulated signal. In some examples, the corona wire voltage 402 (e.g., the frequency of the AC component, the voltages of the AC and/or DC components, etc.) and/or the current density 404 are selected to capture aerosol particles while reducing a time-averaged current from the corona wires 202, 204 to the collection surface 108 and/or the print substrate 208. For example, the corona wire voltage 402 and/or the current density may be selected to generate ions during a first period (e.g., the upper portion of the AC component) to capture aerosol particles adjacent the corona wires 202, 204, to stop generating ions during a second period (e.g., the lower portion of the AC signal) during which aerosol particles diffuse from the print head(s) 206 to the corona wires 202, 204, to generate ions during a third period (e.g., the upper portion of the AC signal) to capture the diffused aerosol particles adjacent the corona wires 202, 204, and so on. The duration(s) of the respective example first, second, and third periods are selected (by selecting the DC components and/or the AC components) to reduce or prevent aerosol particles from diffusing beyond the capture range of the corona wires 202, 204. In the illustrated example, the frequency of the AC component is about 1 kHz.

Figure 5:
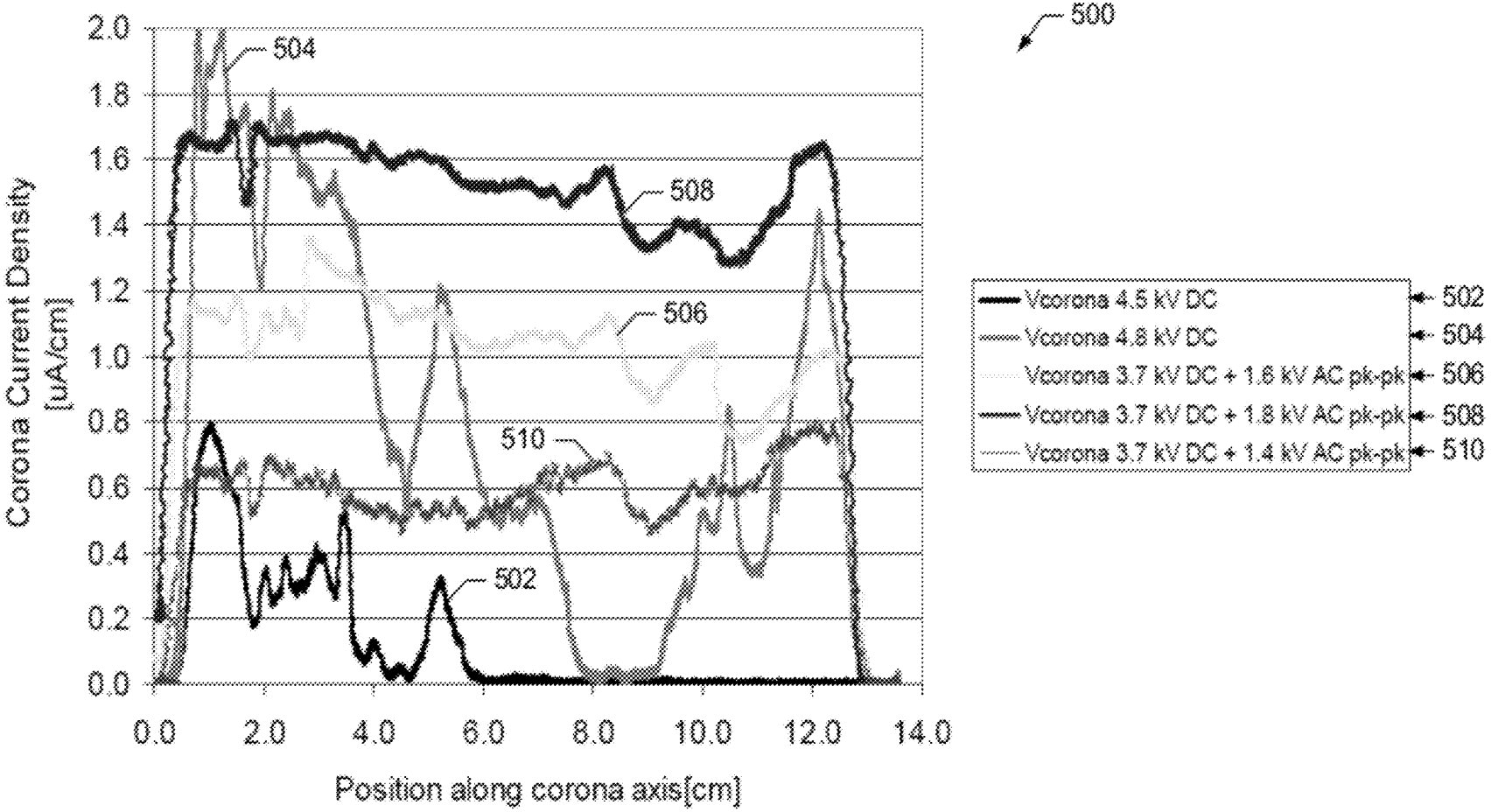
FIG. 5 is a graph illustrating current densities along the corona wire of FIG. 1 in response to example test composite and non-composite signals.

FIG. 5 is a graph 500 illustrating current densities 502, 504, 506, 508, 510 along a corona wire (e.g., the corona wires 202, 204 of FIG. 2) in response to example test electrical excitations. The example current densities 502, 504 occur in response to known electrical excitations having only DC components. In contrast, the example current densities 506, 508, 510 occur in response to example electrical excitations having DC components and AC components.

As illustrated in FIG. 5, the example current densities 506, 508, 510 have substantially less variation along the length of the corona wire. In contrast, the current densities 502, 504 have wide variation along the length of the corona wire. Significantly, the current densities 502, 504 drop to 0 at locations along the corona wire and, thus, do not generate ions in those locations. As a result, the ink aerosols may adhere to the corona wire in those locations, which contaminates the corona wire and reduces corona wire efficiency and/or effectiveness. Corona wires having the example current densities 506, 508, 510 do not suffer from the problems associated with the current densities 502, 504.

Figure 6A:
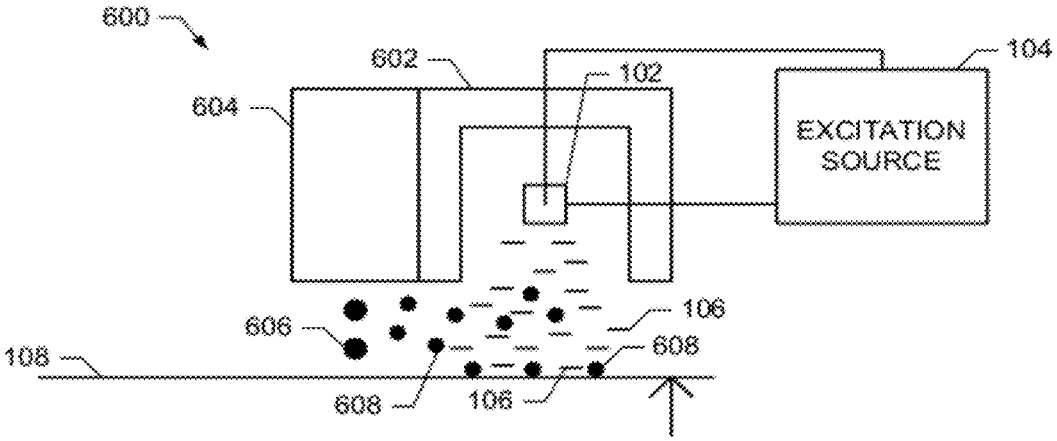
FIGS. 6A-6C illustrate an example process to capture aerosols using the example apparatus of FIG. 1.
Figure 6B:
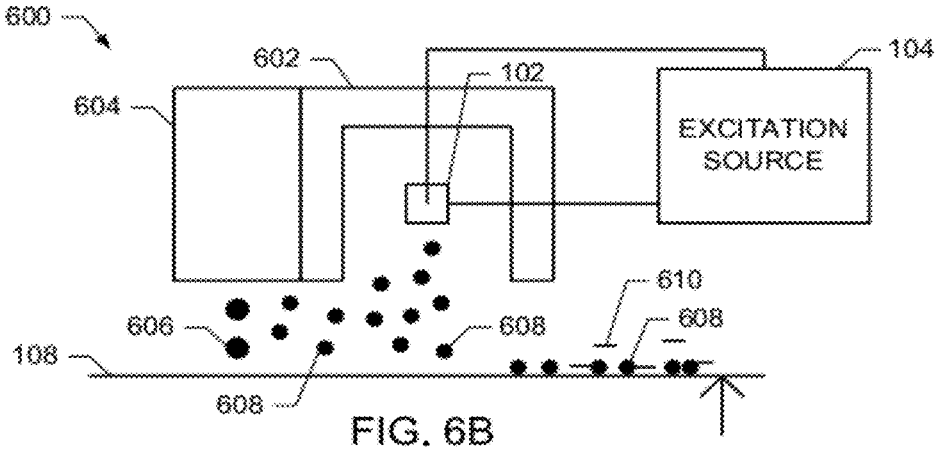
Figure 6C:
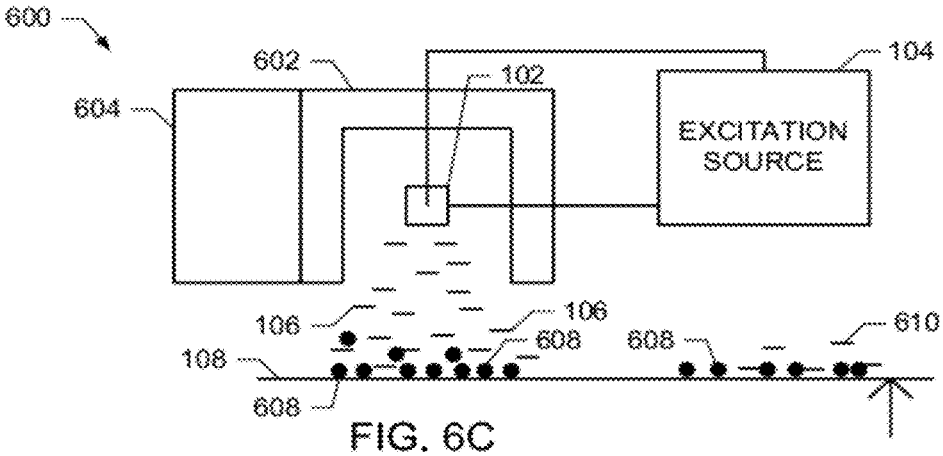

FIGS. 6A-6C show a portion of an example image forming apparatus 600 to illustrate an example process to capture aerosols using the example apparatus 100 of FIG. 1. The example image forming apparatus 600 may be implemented using the example image forming apparatus 200 of FIG. 2. The image forming apparatus 600 of FIGS. 6A-6C includes the example corona wire 102, the connector 103, the example excitation source 104, and the example collection surface 108 of FIG. 1. The example image forming apparatus 600 further includes a corona housing 602 and print head(s) 604 to generate ink droplets 606 and ink aerosol particles 608 (as an unwanted byproduct of the ink droplets). The example corona wire 102 selectively generates ions 106 as described below.

FIG. 6A illustrates the example image forming apparatus 600 at a first time. The example print head(s) 604 generate ink droplets 606 and ink aerosol particles 608. At least some of the ink aerosol particles 608 remain in the air in an area adjacent the corona wire 102. At the first time illustrated in FIG. 6A, the example excitation source 104 applies a voltage to the corona wire 102 that is greater than the corona inception voltage and, thus, the corona wire 102 generates ions 106 (e.g., negative ions). The ions 106 travel toward the collection surface 108 and force the aerosol particles 608 toward the collection surface 108.

FIG. 6B illustrates the example image forming apparatus 600 of FIG. 6A at a second time. At the second time, the excitation source 104 applies a voltage to the corona wire 102 that is less than the inception voltage and, thus, the corona wire 102 does not generate ions. Meanwhile, the print head(s)

604 continue to generate ink droplets 606 and ink aerosol particles 608, which diffuse toward an area adjacent the corona wire 102.

Additionally, the ink aerosol particles 608 that were forced toward the collection surface 108 at the first time remain adhered to the collection surface 108. In the illustrated example, negative charges 610 are also present on the collection surface 108 due to the application of the negative ions 106 by the corona wire 102 at the first time. If the negative charges 610 are sufficiently numerous and/or dense, the charges 610 may negatively affect print quality by causing unwanted movement or deflection of the ink on the collection surface 108. Not generating ions during the second time serves to avoid such excessive negative charge build up and its negative effects.

FIG. 6C illustrates the example image forming apparatus of FIG. 6A at a third time. At the third time, the excitation source 104 again applies a voltage greater than the corona inception voltage and, thus, causes the corona wire 102 to generate the ions 106. The ions 106 force the ink aerosol particles 608 toward the surface 108, reducing or preventing the ink aerosol particles 608 from escaping the image forming apparatus 600.

Figure 7:
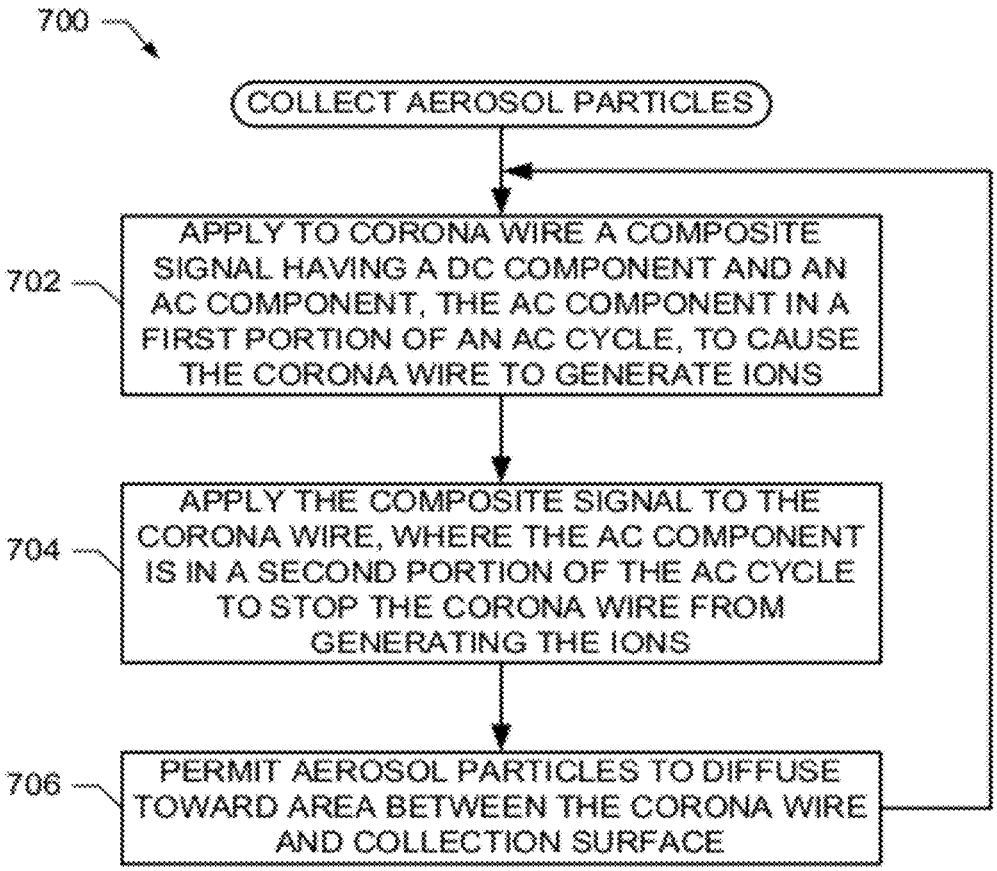
FIG. 7 is a flowchart illustrating example machine readable instructions that may be executed to implement the example apparatus of FIGS. 1, 2, and 6A-6C.

A flowchart representative of example machine readable instructions 700 for implementing the apparatus 100, 200, and 600 of FIGS. 1, 2, and 6A-6C is shown in FIG. 7. In this example, the machine readable instructions 700 comprise a program for execution by a processor such as the processor 802 shown in the example controller 800 discussed below in connection with FIG. 8. The program may be embodied in software stored on a computer readable medium such as a CD-ROM, a floppy disk, a hard drive, a digital versatile disk (DVD), or a memory associated with the processor 802, but the entire program and/or parts thereof could alternatively be executed by a device other than the processor 802 and/or embodied in firmware or dedicated hardware. Further, although the example program is described with reference to the flowchart illustrated in FIG. 7, many other methods of implementing the example apparatus 100, 200, and 600 may alternatively be used. For example, the order of execution of the blocks may be changed, and/or some of the blocks described may be changed, eliminated, or combined.

The example processes of FIGS. 1-2 and 6A-6C may be implemented using coded instructions (e.g., computer readable instructions) stored on a tangible computer readable medium such as a hard disk drive, a flash memory, a read-only memory (ROM), a compact disk (CD), a digital versatile disk (DVD), a cache, a random-access memory (RAM) and/or any other storage media in which information is stored for any duration (e.g., for extended time periods, permanently, brief instances, for temporarily buffering, and/or for caching of the information). As used herein, the term tangible computer readable medium is expressly defined to include any type of computer readable storage and to exclude propagating signals. Additionally or alternatively, the example processes of FIGS. 1-2 and 6A-6C may be implemented using coded instructions (e.g., computer readable instructions) stored on a non-transitory computer readable medium such as a hard disk drive, a flash memory, a read-only memory, a compact disk, a digital versatile disk, a cache, a random-access memory and/or any other storage media in which information is stored for any duration (e.g., for extended time periods, permanently, brief instances, for temporarily buffering, and/or for caching of the information). As used herein, the term non-transitory computer readable medium is expressly defined to include any type of computer readable medium and to exclude propagating signals.

The example instructions 700 may be implemented by the example apparatus 100 of FIG. 1 and/or the example image forming apparatus 200, 600 of FIGS. 2 and 6A-6C. For illustration purposes, the example instructions 700 will be discussed with reference to the example apparatus 100 of FIG. 1.

The example instructions 700 begin by applying (e.g., via the excitation source 104) to the example corona wire 102 of FIG. 1 a composite signal having a DC component and an AC component (block 702). During block 702, the AC component of the example composite signal is in a first portion of an AC cycle (e.g., a first half-period of an AC cycle having a higher voltage than a second half-period). As a result, the example corona wire 102 has a voltage greater than an inception voltage (e.g., within the stable voltage region 308 of FIG. 3) and, thus, generates ions 106 that are directed toward a collection surface (e.g., the example substrate 108 of FIG. 1).

During block 704, the example excitation source 104 applies the composite signal to the example corona wire 102 of FIG. 1, where the AC component of the composite signal is in a second portion of the AC cycle (e.g., the second half-period of an AC cycle having a lower voltage than the first half-period of block 702). As a result, the example corona wire 102 has a voltage below the stable region 308 (e.g., within the unstable region 306, lower than the inception voltage) and stops and/or reduces generation of ions. Stopping the generation of ions permits aerosol particles to diffuse toward an area between the corona wire 102 and the collection surface (e.g., the substrate 108) (block 706). The example instructions 700 then return to block 702 to apply the composite signal to the example corona wire 102 using the first portion of the AC cycle. The example instructions 700 of FIG. 7 may iterate in this manner while a printing operation or other fluid jetting operation is being performed.

Figure 8:
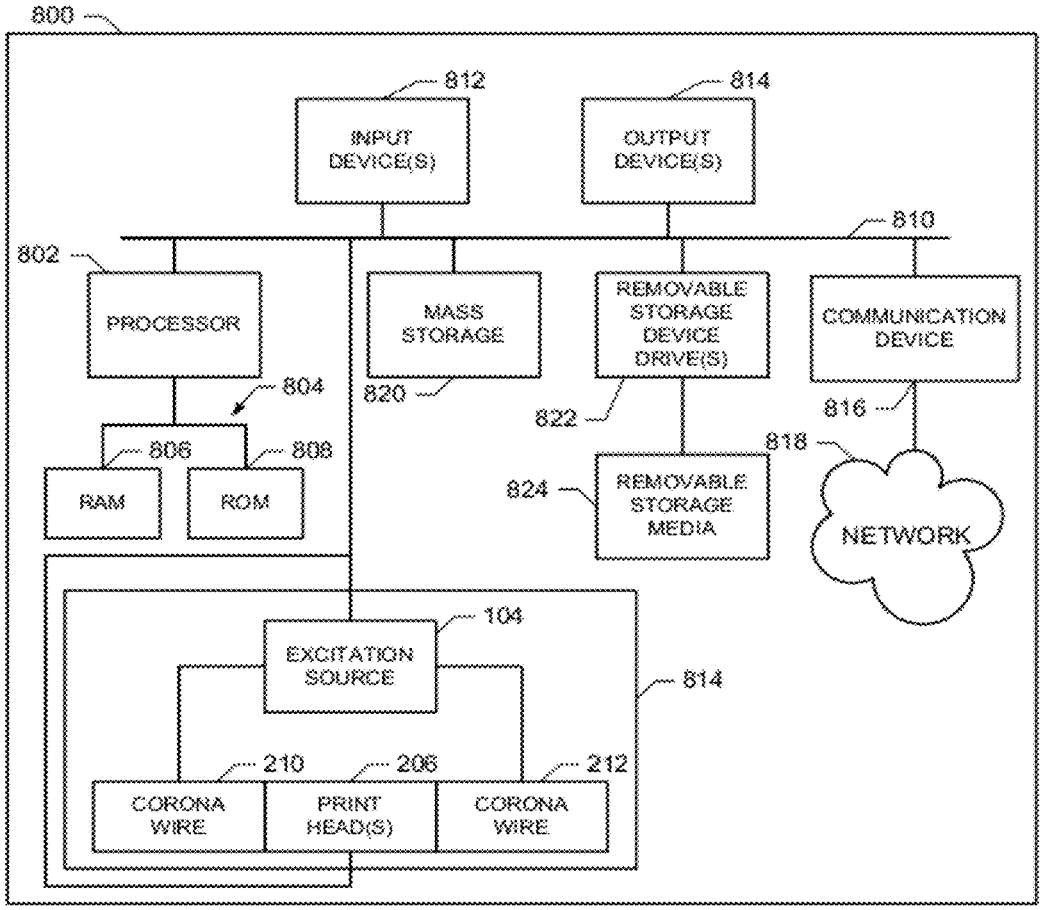
FIG. 8 is a is a block diagram of an example machine capable of executing the instructions of FIG. 7 to implement the apparatus of FIGS. 1, 2, and 6A-6C.

FIG. 8 is a is a block diagram of an example image forming apparatus incorporating 800 a control platform capable of executing the instructions 700 of FIG. 7 to implement the apparatus of FIGS. 1, 2, and 6A-6C. The control platform can be, for example, a controller for a printer or other image forming apparatus and/or any other type of processing or controller platform to execute printing commands. The control platform of the instant example includes a processor 802. For example, the processor 802 can be implemented by one or more microprocessors, embedded microcontrollers, system on a chip (SoC), and/or any other type of processing, arithmetic, and/or logical unit.

The processor 802 is in communication with a main memory 804 including a volatile memory 806 and a non-volatile memory 808. The volatile memory 806 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 808 may be implemented by read-only memory (ROM), flash memory, and/or any other desired type of memory device. Access to the main memory 804 is typically controlled by a memory controller (not shown).

The controller 800 also includes an interface circuit, such as a bus 810. The bus 810 may be implemented by any type of interface standard, such as an Ethernet interface, a universal serial bus (USB), and/or a PCI express interface.

Input device(s) 812 are connected to the bus 810. The input device(s) 812 permit a user to enter data and commands into the processor 802. The input device(s) 812 can be implemented by, for example, a keyboard, a programmable keypad, a mouse, a touchscreen, a track-pad, a trackball, isopoint, and/or a voice recognition system.

Output device(s) 814 are also connected to the bus 810. The example output device(s) 814 of FIG. 8 are implemented, for example, by display devices (e.g., a liquid crystal display, a cathode ray tube display (CRT), and/or speakers) and printer devices (e.g., print head(s), substrate path control, aerosol control, etc.). In particular, the processor 802 of the illustrated example provides commands to the example excitation source 104 via the bus 810. The processor 802 of the illustrated example provides commands to the excitation source 104 of FIG. 1 in order to generate a composite signal producing ions that capture aerosols without excessively charging a print substrate. The example processor 802 of FIG. 8 further provides instructions to the print head(s) 206 of FIG. 2 via the bus 810 in order to generate ink droplets for forming an image on a print substrate. The output device(s) 814 of FIG. 8 may additionally or alternatively include, for example, substrate advancement device(s) to advance the example substrate 108 of FIGS. 1, 2, and 6A-6C. In some examples the bus 810 includes a graphics driver card to output graphics on a display device.

The example bus 810 also includes a communication device 816 such as a wired or wireless network interface card to facilitate exchange of data (e.g., images to be formed on a substrate) with external computers via a network 818.

The example controller 800 of FIG. 8 further includes mass storage device(s) 820 and removable storage drive(s) 822 for storing software and data. Machine readable removable storage media 824 may be inserted into the removable storage drive 822 to allow the removable storage drive 822 to provide the instructions contained on the media 824 to, for example, the processor 802. Examples of such mass storage devices 820 and/or computer readable media include floppy disks, hard drive disks, compact discs (CDs), digital versatile discs (DVDs), memory cards, Universal Serial Bus (USB) storage drives, and/or any other articles of manufacture and/or machine readable media capable of storing machine readable instructions such as the coded instructions 700 of FIG. 7. Accordingly, the coded instructions 700 of FIG. 7 may be stored in the machine readable removable storage media 824, the mass storage device 820, in the volatile memory 806, and/or in the non-volatile memory 808.

From the foregoing, it will be appreciated that the above-disclosed apparatus, printers, and articles of manufacture provide efficient collection of aerosols using corona wires with AC and DC excitation. In particular, disclosed example apparatus, printers, and articles of manufacture utilize a composite signal to provide substantially even current densities over the length of the corona wire(s), which reduces or prevents contamination of the corona wire(s) and improves image quality. Additionally, example apparatus, printers, and articles of manufacture use a relatively low time-averaged current density to generate the ions, which reduces or prevents excess charging of a print substrate or collection surface which would otherwise reduce print quality. Further, example apparatus, printers, and articles of manufacture disclosed herein provide an electrical excitation (e.g., a composite signal) having an AC component and a DC component. Further, example apparatus, printers, and articles of manufacture disclosed herein may be implemented without adding substantial cost as compared to prior apparatus and methods as much of the same hardware may be employed. Further, excitation sources disclosed herein may be retrofit into existing printers and the like to improve printer performance.

Although certain example apparatus, printers, and articles of manufacture have been disclosed herein, the scope of coverage of this patent is not limited thereto. On the contrary, this patent covers all apparatus, printers, and articles of manufacture fairly falling within the scope of the claims of this patent.

What is claimed is:

1. An apparatus comprising:

a corona wire; and an excitation source to provide to the corona wire a composite signal having a direct current component and an alternating current component, the alternating current component having a cycle, a first portion of the cycle being sufficient to cause the composite signal to exceed to inception voltage at which ions are generated by the corona wire and a second portion to cause the composite signal to fall beneath the inception voltage, the excitation source to avoid causing the corona wire to substantially charge a substrate.

2. An apparatus as defined in claim 1, wherein the corona wire is to generate a pulse width modulated current in response to the composite signal.

3. An apparatus as defined in claim 1, wherein the corona wire is to selectively generate ions based on the composite signal to direct aerosol particles toward a collection surface.

4. An apparatus as defined in claim 3, wherein the collection surface is at least one of a print substrate or a platen.

5. An apparatus as defined in claim 1, wherein the excitation source is to cause the corona wire to have a time-averaged current density less than 10 microamperes per centimeter.

6. An apparatus as defined in claim 1, wherein the direct current component is substantially constant during the first and second portions.

7. An image forming apparatus, comprising:

a print head to apply ink to a substrate; and a first corona wire to be coupled to a composite signal having a direct current component and an alternating current component, the first corona wire to selectively generate ions to collect aerosol particles and to avoid substantially charging the substrate.

8. An image forming apparatus as defined in claim 7, further comprising an excitation source to generate the composite signal during operation of the image forming apparatus.

9. An image forming apparatus as defined in claim 8, wherein the excitation source comprises a step-up transformer to generate the alternating current component and a rectifier to generate the direct current component from the increased alternating current component.

10. An image forming apparatus as defined in claim 7, further comprising a second corona wire located adjacent the print head opposite the first corona wire, the second corona wire to selectively generate the ions to collect the aerosol particles.

11. An image forming apparatus as defined in claim 7, wherein the corona wire is to have a time-averaged current density less than 10 microamperes per centimeter.

12. An image forming apparatus as defined in claim 7, wherein the alternating current component has a frequency to substantially prevent escape of the aerosol particles from the image forming apparatus.

13. An image forming apparatus as defined in claim 7, further comprising a collection surface to collect the aerosol particles.

14. A tangible article of manufacture comprising machine readable instructions which, when executed, cause a machine to at least:

apply, at a first time, a first voltage comprising an alternating current component and a direct current component to a corona wire to generate a first plurality of ions to direct first aerosol particles toward a collection surface;

stop the corona wire from generating ions at a second time to allow second aerosol particles to diffuse toward the corona wire; and apply, at a third time, a second voltage comprising the alternating current component and the direct current component to the corona wire to generate a second plurality of ions to direct the second aerosol particles toward the collection surface.

15. An article of manufacture as defined in claim 14, wherein the direct current component has a voltage less than a corona wire inception voltage.

16. An article of manufacture as defined in claim 15, wherein the first voltage is a composite of the direct current component and the alternating current component, the first voltage being greater than the corona wire inception voltage.

17. An article of manufacture as defined in claim 14, wherein the instructions stop the corona wire from generating the ions by reducing the voltage of the alternating current component such that a combination of the direct current component and the alternating current component is less than the corona wire inception voltage.

18. An article of manufacture as defined in claim 14, wherein the instructions are to cause a length between the first and third times to be sufficiently brief to reduce escape of the aerosol particles from an image forming apparatus.

19. An article of manufacture as defined in claim 14, wherein the instructions further cause the machine to advance the collection surface to cause the second aerosol particles to be directed to a different portion of the collection surface than the first aerosol particles.

20. An article of manufacture as defined in claim 14, wherein the direct current component is substantially constant at the first, second, and third times.

* * * * *